US006061939A

United States Patent [19]

Gildea

[11] Patent Number: 6,061,939

[45] **Date of Patent: *May 16, 2000**

[54] DEVICE FOR CONVERTING A POLE INTO A SIMULATIVE PRODUCT DISPLAY

[76] Inventor: Sean T. Gildea, 58 Harbor Ave., Marblehead, Mass. 01945

[ * ] Notice: This patent is subject to a terminal disclaimer.

[21] Appl. No.: 09/119,916

[22] Filed: Jul. 21, 1998

Related U.S. Application Data

[63] Continuation-in-part of application No. 08/820,366, Mar. 12, 1997, Pat. No. 5,782,027.

[51] Int. Cl.[7] ..... G09F 5/08

[52] U.S. Cl. ..... 40/538; 40/607; 52/736.4

[58] Field of Search ..... 40/538, 607, 624; 52/736.3, 736.4; 405/216; 404/6, 9, 10; 446/366; 116/63 R

[56] References Cited

U.S. PATENT DOCUMENTS

| | | | |
|---|---|---|---|
| 2,625,762 | 1/1953 | Mccoll . | |
| 2,870,558 | 1/1959 | Fuller . | |
| 3,104,875 | 9/1963 | Doyle . | |
| 3,579,885 | 5/1971 | Iverson . | |
| 5,066,163 | 11/1991 | Whitaker | 404/10 |
| 5,116,204 | 5/1992 | Power et al. | 40/607 |
| 5,190,214 | 3/1993 | Dewailly . | |
| 5,306,106 | 4/1994 | Mileti | 404/6 |
| 5,487,618 | 1/1996 | Cox | 404/6 |
| 5,561,930 | 10/1996 | Ashley et al. | 40/538 |
| 5,605,414 | 2/1997 | Fuller | 404/6 |
| 5,755,528 | 5/1998 | Kulp et al. | 404/6 |
| 5,782,027 | 7/1998 | Gildea | 40/607 |

FOREIGN PATENT DOCUMENTS

| | | | |
|---|---|---|---|
| 50647 | 10/1966 | Germany | 404/10 |
| 2830876 | 10/1979 | Germany | 404/10 |
| 1483485 | 8/1977 | United Kingdom | 404/10 |

*Primary Examiner*—Blair M. Johnson
*Attorney, Agent, or Firm*—O'Connell Law Firm

[57] ABSTRACT

A display device for converting a pole into a simulative product display comprising first and second body elements each with an outer surface simulating in three dimensions a portion of a product to be advertised and together simulating in three dimensions and throughout 360 degrees an entire product to be advertised and further comprising an elongate member for fastening the first body element and the second body element about a pole. A substantially rigid reinforcing member may be disposed within an open inner volume of the display device. The reinforcing member may have an aperture therein with an impact absorbing member disposed therewithin. An open inner volume of the impact absorbing member may be occupied by a disparate impact absorbing material such as particulate matter or liquid.

A retaining base with a base floor and an annular retaining wall disposed at the periphery of the base floor base may be provided for retaining a bottom end of the first and second body elements. The retaining base may be fastened to the first and second body elements by, for example, retaining bolts that may be fixed relative to a surrounding environmental surface or by ground spikes projecting through the display device and into a surrounding environmental surface. A volume of ballast may be disposed within the open inner volume of the display device for maintaining the display device in a given location and orientation.

16 Claims, 5 Drawing Sheets

DEVICE FOR CONVERTING A POLE INTO A SIMULATIVE PRODUCT DISPLAY

This application is a continuation-in-part of application Ser. No. 08/820,366 filed on Mar. 12, 1997, now U.S. Pat. No. 5,782,027.

FIELD OF THE INVENION

The present invention relates generally to devices for advertising products. More particularly, this specification and the accompanying drawings disclose a device for converting a pole into a simulative product display.

BACKGROUND OF THE INVENTION

For time immemorial, signs of metal, wood, and plastic have been employed to depict advertiser's products and services. Consequently, advertising displays, even those simulating the advertised product or service in two and even three dimensions, are known to the art. The need for effective advertising has resulted in signs being situated at nearly every conceivable location both indoors and out.

Nonetheless, one available advertising location appears not to have been put to its full use. One will realize that poles may be found in nearly any environment. There are support poles in buildings, utility poles lining streets, and poles on ski mountains for supporting ski lifts. One important point that the shear multiplicity of poles raises relative to the instant invention is that a tremendous amount of unique advertising space as of yet has been left underused. Thus far, advertising on poles has been limited substantially to the posting of sheets of paper and the like with tape or tacks.

Certainly, one could set forth a wide variety of other types of locations where standard poles comprise unattractive, dangerous, and potentially damaging utilitarian structures of arguably wasted advertising space. It is worth further noting that each different type of location where poles are located is unique in the degree of danger and potential harm that the respective pole could cause and the type of collision that could occur with the pole. For example, a pole inside a department store may pose little danger to the observant passerby, and any collision with the pole, whether by a shopping cart or a person's body, would comprise an impact of relatively low speed and energy. On the other hand, a collision of an automobile with a utility pole or of a skier with a ski lift pole would be likely to occur at a high rate of speed with a violent impact.

In light of the foregoing, it becomes clear that it would be useful if one were to craft an advertising device capable of effectively converting a pole into a simulative product display thereby making effective use of otherwise underused advertising space, improving the appearance of the pole, and, potentially, serving as a protective barrier around the pole. It is also clear that such a device that could adapt to the nature of its use would comprise a marked advance in the art.

SUMMARY OF THE INVENTION

Advantageously, the present disclosure is directed to a device for converting a pole into a simulative product display. Although a number of objects and advantages of the invention will become obvious to one who reads this specification and reviews the accompanying drawings, a few are worth particular mention. For example, a principal object of the present invention is to provide an advertising display that makes optimal use of poles as an advertising medium. An incidental object of the invention is to improve the appearance of poles and their surrounding environment. A further object of the invention is to provide a protective shield that surrounds a pole to which it is coupled for improving the safety of persons relative to the pole and for reducing damage to the pole due to collisions. Still another object of the invention is to provide a device with the foregoing characteristics that is readily adaptable to suit the nature of its use.

In accomplishing these objects, the invention essentially comprises a display device for converting a pole into a simulative product display comprising first and second body elements each with an outer surface simulating in three dimensions a portion of a product to be advertised and together simulating in three dimensions and throughout 360 degrees an entire product to be advertised and further comprising an elongate member of, for example, plastic for fastening the first body element to the second body element to form the first and second body elements into a unitary structure. The elongate member may have a first end coupled to an inner surface of the first body element and a second end coupled to an inner surface of the second body element. The elongate may comprise a first elongate section coupled to a second elongate section by a ratcheting engagement mechanism.

A substantially rigid reinforcing member comprising a generally flat panel with an inner edge for contacting a pole and an outer edge for contacting the first and second body elements may be disposed within an open inner volume of the display device. The reinforcing member may have an aperture therein with an impact absorbing member disposed in the aperture. An open inner volume of the impact absorbing member may be occupied by a disparate impact absorbing material such as particulate matter or liquid. A retaining base with a base floor and an annular retaining wall disposed at the periphery of the base floor may be provided for retaining a bottom end of the first and second body elements. The retaining base may be fastened to the first and second body elements by, for example, retaining bolts that may be fixed relative to a surrounding environmental surface or by ground spikes projecting through the display device and into a surrounding environmental surface. A volume of ballast may be disposed within the open inner volume of the display device for maintaining the display device in a given location and orientation.

The foregoing discussion broadly outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION

Figure 1:
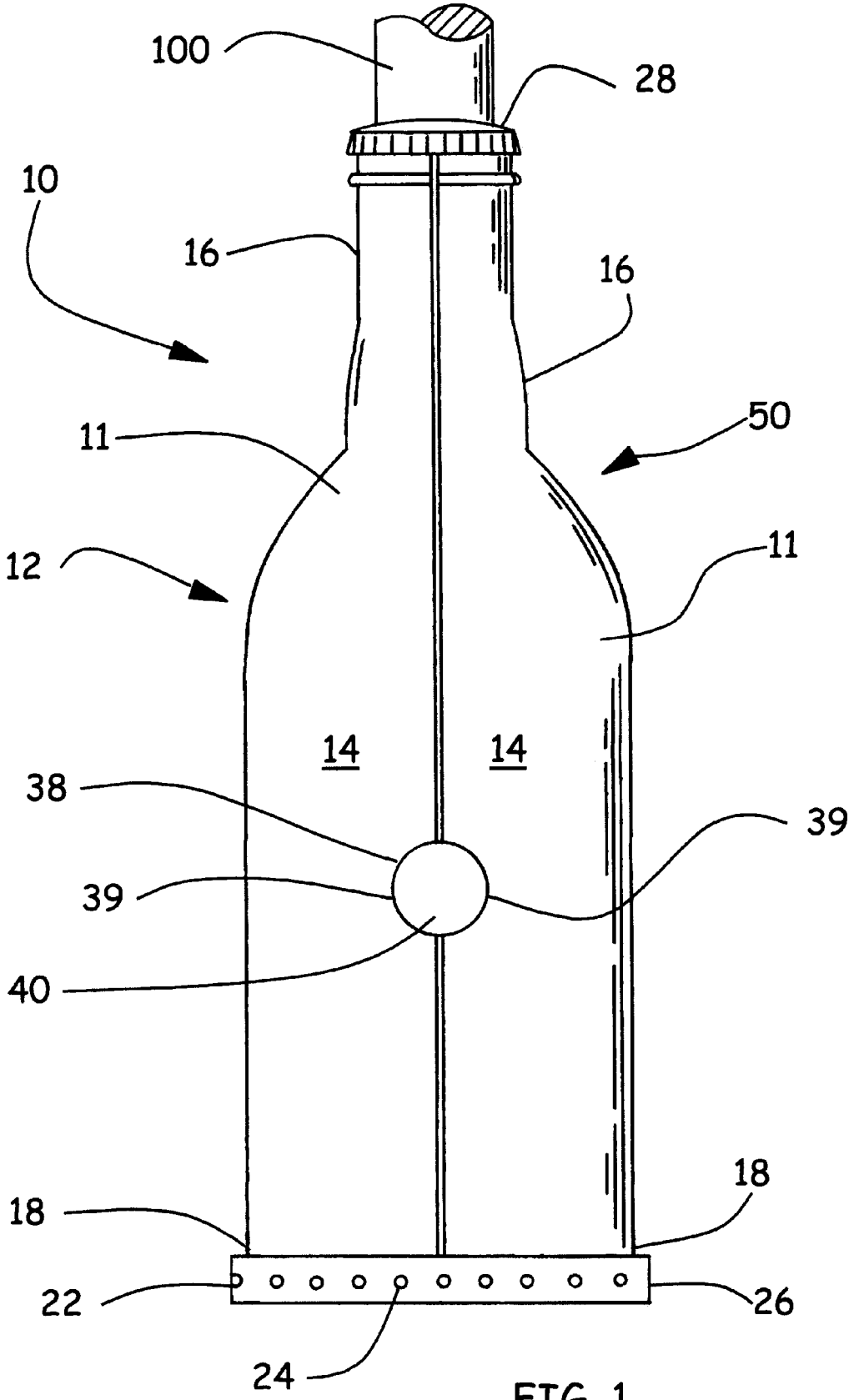
FIG. 1 is a view in side elevation of a display device according to the present invention shown fastened about a pole.

Referring more particularly to FIG. 1, the figure shows a display device according to the present invention generally indicated at 10. The display device 10 for converting a pole into a simulative product display is shown coupled to a pole 100, which could be any pole in substantially any environment. In this embodiment, the display device 10 is shown simulating a beverage bottle. However, the display device 10 may be adapted for simulating many other products including, for example, boxed products, canned products, and bagged products.

In the embodiment of FIG. 1, the display device 10 comprises a first body element 12 and a second body element 50 wherein each of the body elements 12 and 50 has an outer surface 14 that simulates in three dimensions approximately one-half of a beverage bottle. Since each of the first and second body elements 12 and 50 simulates approximately one-half of a product to be displayed, when coupled together the first and second body elements 12 and 50 simulate an entire product to be displayed in three dimensions and throughout 360 degrees.

Figure 2:
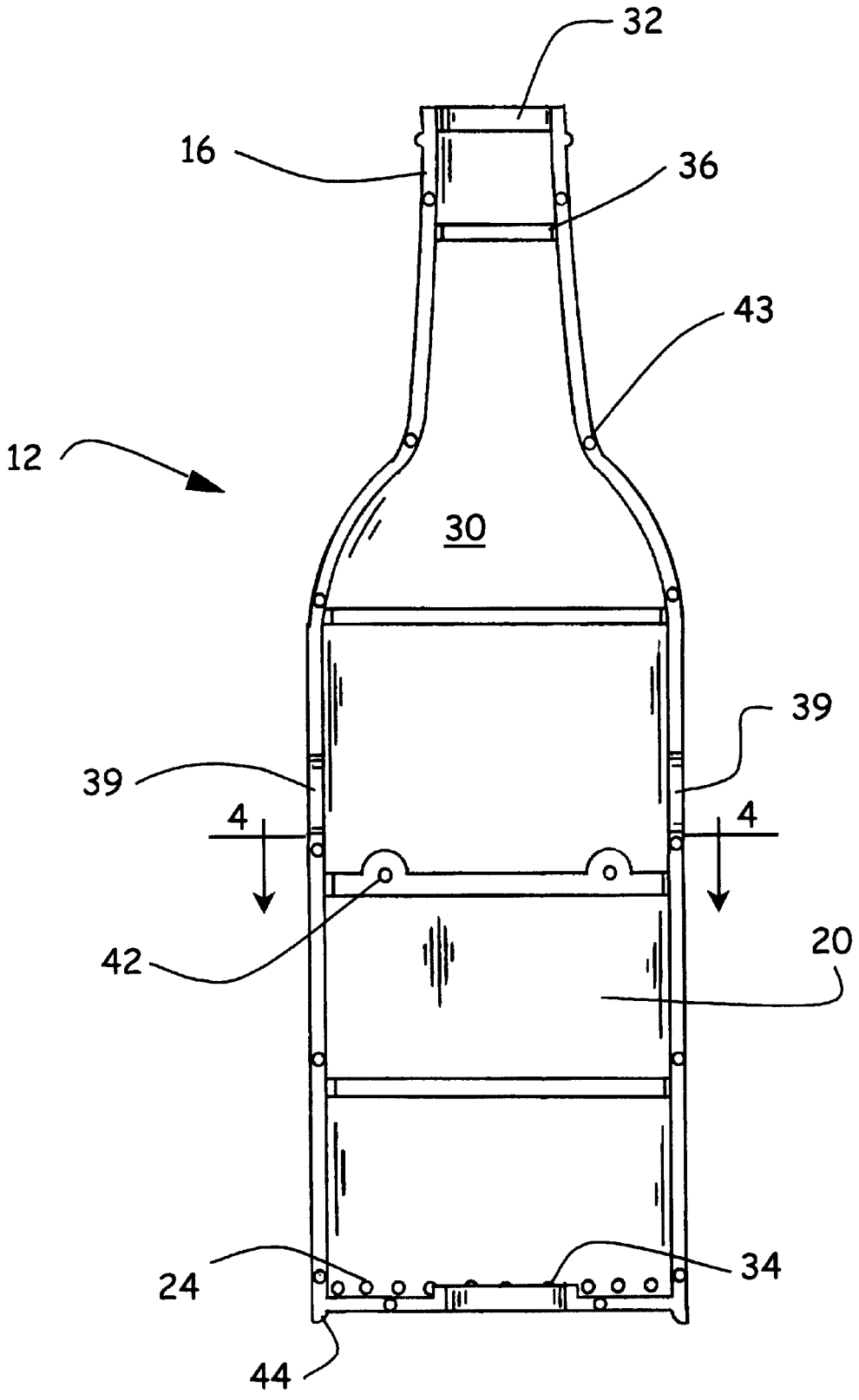
FIG. 2 is a view in rear elevation of a first body element according to the present invention.
Figure 3:
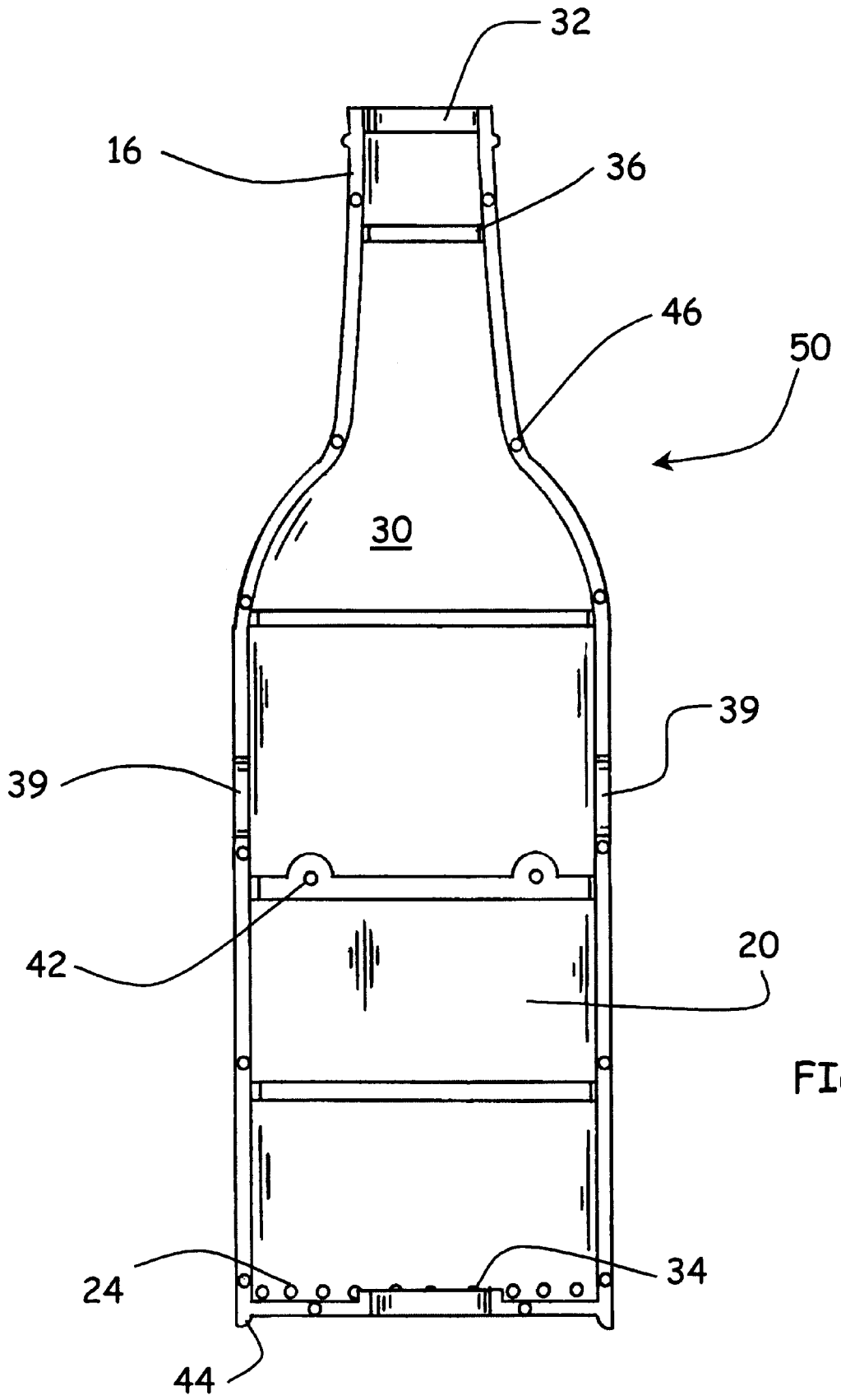
FIG. 3 is a view in rear elevation of a second element according to the present invention.

Each of the first and second body elements 12 and 50 comprises a shell 11 with a bottom portion 18 and a simulated bottle neck 16. Naturally, each of the first and second body elements 12 and 50 could be formed from a wide variety of materials. In this preferred embodiment, they are formed from an appropriately chosen plastic. Each shell 11 is generally hollow such that each shell 11 defines an open inner volume 20, which is best seen in FIGS. 2 and 3. As FIG. 1 shows, an annular strap 28 simulating a bottle cap surrounds the upper end of the simulated bottle necks 16 of the first and second body elements 12 and 50 to fasten the two together. Preferably, the strap 28 is of a resilient material and, additionally or alternatively, is adjustable in length. When fastened together, the first and second body elements 12 and 50 together define a cumulative open inner volume, which is also indicated at 20 in FIG. 4.

As will be discussed more fully below, FIG. 1 shows that a retaining base 22 retains the bottom portion 18 of each of the first and second body elements 12 and 50. The retaining base 22 is fastened to the bottom portion 18 of each of the first and second body elements 12 and 50 by a plurality of base fastening bolts 24 that project through a peripheral annular retaining wall 26 of the retaining base 22 and into either the first or second of the first and second body elements 12 and 50.

An access aperture 38 is disposed in the first and second body elements 12 and 50 for allowing a user access to the inner volume 20 of the display device 10 even when the first and second body elements 12 and 50 are fastened together. As one can see, the access aperture 38 is actually the cumulative formation of a pair of opposed arcuate openings 39 in each of the first and second body elements 12 and 50. A plug 40, which may be wedged or screwed into place, is provided for sealing the access aperture 38 when access to the open inner volume 20 is not needed.

Referring to FIG. 2, one sees a view in rear elevation of the first body element 12. The figure shows that the first body element 12 has an inner surface 30, a first pole engaging lip 32, and a second pole engaging lip 34. The first and second pole engaging lips 32 and 34 act as a means for engaging a pole 100. A plurality of disk retaining grooves 36, the function of which will be explained below, are formed integrally with the first body element 12. Each of the disk retaining grooves 36 essentially comprises a furrow disposed between a pair of ridges that are disposed on the inner surface 30 of the first body element.

A pair of fastening holes 42, the function of which will be discussed below, are disposed in the first body element 12. Also, a plurality of aligning nipples 43 are disposed about the periphery of the first body element 12 for aiding in aligning the first body element 12 with the second body element 50 as will be discussed further below. Still further, an annular ridge 44, the function of which will be discussed below, is disposed about the periphery of the bottom portion 18 of the first body element 12.

Looking next to FIG. 3, one sees a view in rear elevation of the second body element 50. As the identical reference numerals indicate, the second body element 50 in many respects is a mirror image of the first body element 12. However, instead of the aligning nipples 43, the second body element 50 has a plurality of aligning recesses 46 disposed about its periphery. With this, when the first and second body elements 12 and 50 are fastened together, the aligning nipples 43 will align with the aligning recesses 46 to ensure that the first and second body elements 12 and 50 are aligned about their entire peripheries.

Figure 4:
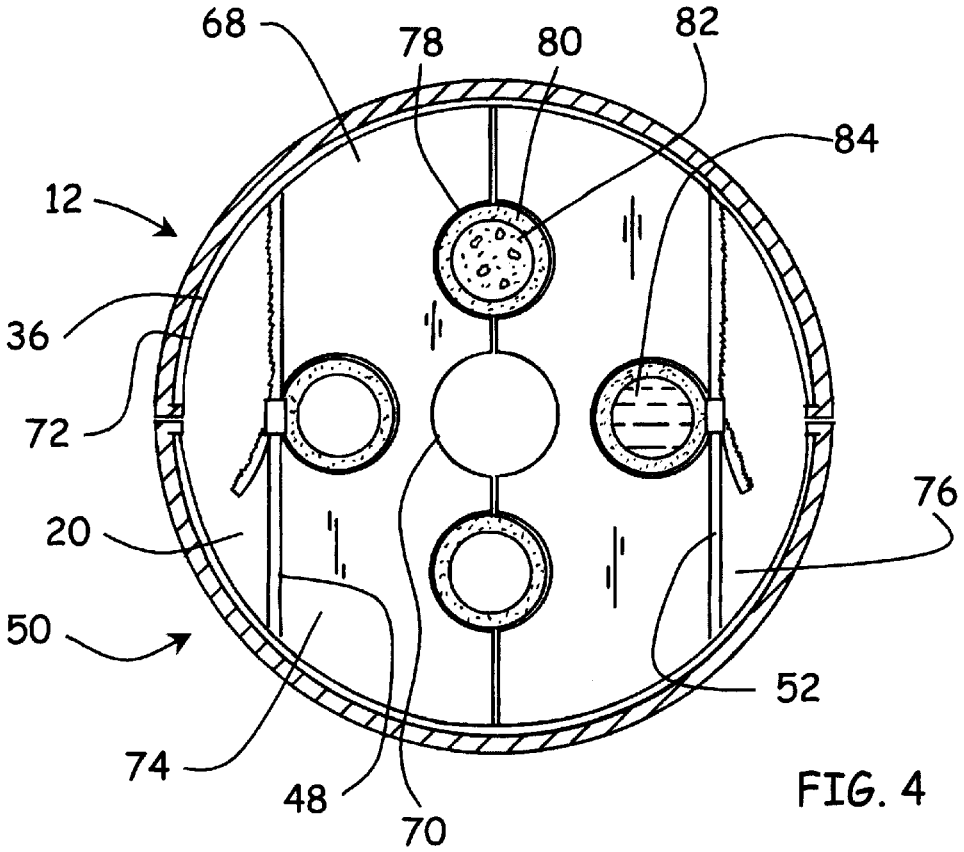
FIG. 4 is a view in cross section of the display device taken along the line 4—4 in FIG. 2.
Figure 5:
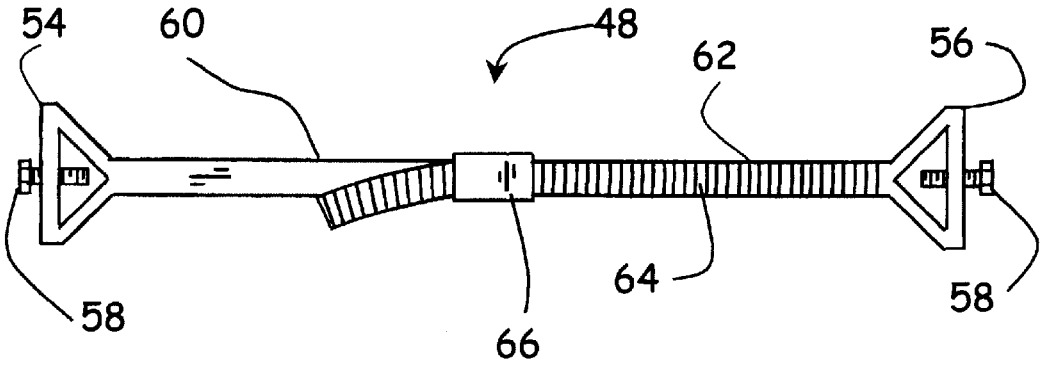
FIG. 5 is a view in side elevation of a fastening member according to the present invention.

Many of the inner workings of the preferred display device 10 can be seen best in FIG. 4, which is a cross section of the display device 10 taken along the line 4—4 in FIG. 2. As a result, in FIG. 4 one sees how the first body element 12 is fastened to the second body element 50 such that the two form a unitary structure. Although a number of fastening means could accomplish this important result of fixedly fastening the first and second body elements 12 and 50 together, in this preferred embodiment the fastening means comprises first and second elongate fastening members 48 and 52. For clarity, FIG. 5 shows the first fastening member 48 apart from the remainder of the display device 10. The second fastening member 52 is substantially identical thereto. Although the fastening members 48 and 52 could be formed from a wide variety of materials, it is presently contemplated that they be formed of a generally rigid material, such as plastic or the like.

Looking to FIGS. 4 and 5 in combination, one sees that the fastening members 48 and 52 each have a first end 54 fixedly coupled to the first body element 12 and a second end 56 fixedly coupled to the second body element 50. This is accomplished by use of fastening bolts 58 that pass through the fastening holes 42 of the first and second body elements 12 and 50 and into the first and second ends 54 and 56 of the first and second fastening members 48 and 52. As FIG. 4 shows, each fastening member 48 and 52 actually comprises a first elongate section 60 and a second elongate section 62. A plurality of ratchet ridges 64 are disposed on the second elongate section 62 while a ratchet buckle 66 is disposed on the first elongate section 60. In use, the ratchet ridges 64 and the ratchet buckle 66 can be operatively engaged by a user to pull the first and second body elements 12 and 50 into intimate contact.

FIG. 4 also shows that the display device 10 further comprises a substantially rigid reinforcing member 68 disposed within the open inner volume 20. The reinforcing member 68 has an inner edge 70 comprising a pole aperture for contacting a pole (not shown in this figure) about which the first and second body elements 12 and 50 are disposed and an outer edge 72 for contacting the first and second body elements 12 and 50 whereby the reinforcing member 68 tends to prevent the first and second body elements 12 and 50 from compressing in response to an impact to the display device 10. In this embodiment, the reinforcing member 68 comprises a flat disk-shaped panel of, for example, plastic that actually consists of a first half 74 and a second half 76. In practice, the first and second halves 74 and 76 of the reinforcing member 68 are disposed in a disk retaining groove 36. As FIGS. 2 and 3 would imply, a plurality of reinforcing members 68 may be employed with one in each of the disk retaining grooves 36.

From FIG. 4, one will see that the reinforcing member 68 has a plurality of annular apertures 78 disposed therein. These apertures 78 allow a plurality of impact absorbing members 80 comprising cylinders, or preferably tubes, of impact absorbing material, such as plastic foam, to be disposed passing through the reinforcing member 78. Where an impact absorbing member 80 is tubular, an open inner volume of the impact absorbing member 80 could have a disparate impact absorbing material, such as particulate matter 82 or liquid 84, disposed therein. With this, the display device 10 is able to adapt readily to the many different demands that different venues exhibit. For example, where any possible impacts with the display device 10 are likely to be of minor severity (e.g., in a department store or the like), the display device 10 may be deployed without impact absorbing members 80 or with impact absorbing members 80 that are relatively thin and pliable. However, where a possible impact is likely to be severe (e.g., on a ski mountain or on a roadside), the display device 10 could be deployed with impact absorbing members 80 that are relatively thick and capable of absorbing much energy. Furthermore, the impact absorbing members 80 could be filled with an additional, disparate impact absorbing material, such as particulate matter 82 or liquid 84, thereby further increasing their ability to absorb a severe impact.

Figure 6:
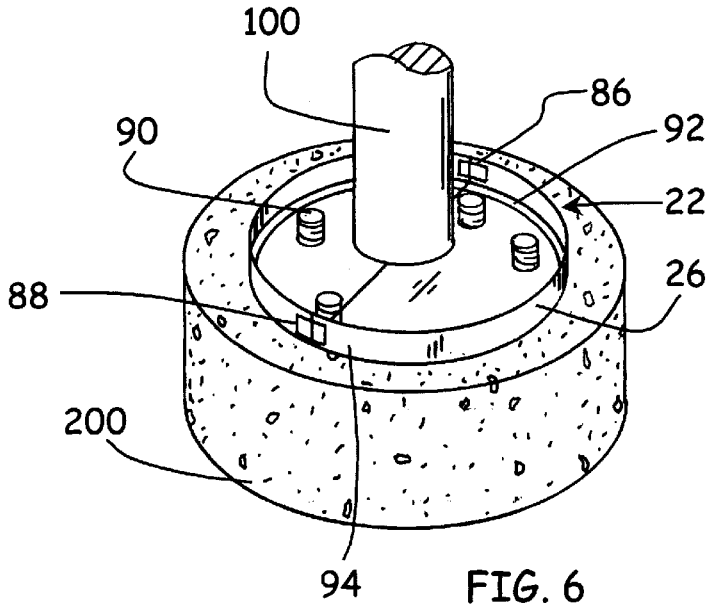
FIG. 6 is a perspective view of a retaining base according to the present invention shown fastened about a pole.

Looking next to FIG. 6, one sees the retaining base 22 disposed about a pole 100 without the remainder of the display device 10. As FIG. 6 shows, the retaining base 22 actually comprises a first half 92 coupled to a second half 94 by a hinge 86. The first and second halves 92 and 94 are fixed about the pole 100 by a locking mechanism 88. A plurality of retaining bolts 90 project upwardly from the retaining base 22 for engaging and retaining the first and second body elements 12 and 50. Although the retaining bolts 90 may be integral with the retaining base 22, in this embodiment greatest security is achieved by employing retaining bolts 90 that are already in place for retaining the pole 100. This would be the most likely practice where the pole 100 is retained in place on, for example, a cement slab 200 by the retaining bolts 90 as is often the case with light poles, ski lift poles, and the like. The retaining base 22 better retains the first and second body elements 12 and 50 by virtue of a peripheral groove 92 that cooperates with the annular ridge 44 that is disposed about the periphery of the bottom portion 18 of the first and second body elements 12 and 50.

Figure 7:
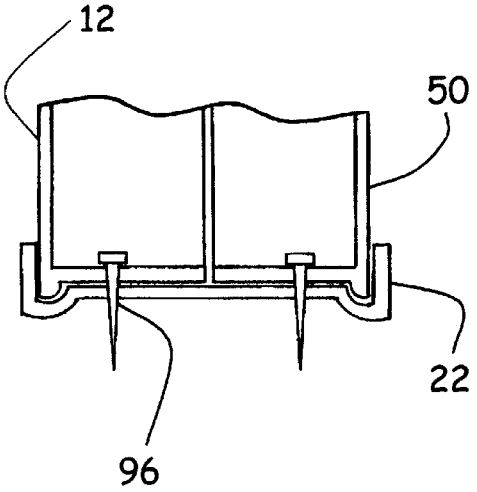
FIG. 7 is a partial view in cross section of an alternative embodiment of the present invention.
Figure 8:
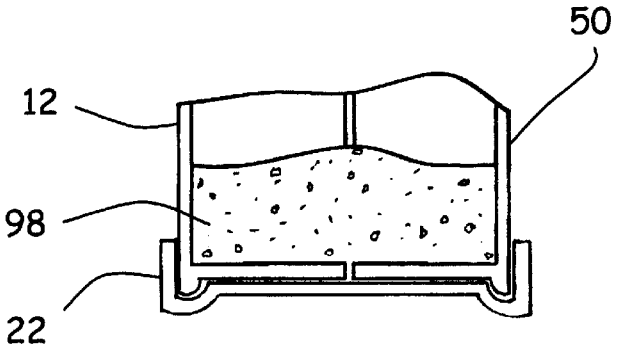
FIG. 8 is a partial view in cross section of another alternative embodiment of the present invention.

Of course, other means of fixing the display device 10 in place could be employed. For example, as is shown in FIG. 7, where the display device 10 does not enjoy the ability to make use of pre-set retaining bolts 90, ground spikes 96 could be driven directly through the first and second body elements 12 and 50, the retaining base 22, and into a surrounding volume of ground or the like (not shown). Still further, as FIG. 8 shows, the display device 10 could be held in a given location and orientation by having the open inner volume 20 at least partially filled with ballast 98, such as sand or the like.

From the foregoing, it is apparent that the present invention possesses a number of advantages over the prior art. For example, by its ability to convert a pole 100 into a simulative advertising display, the invention enables the optimal use of poles 100 as product display mediums. Furthermore, the invention improves the appearance of a pole 100 to which it is coupled. Also, where the device 10 is designed for impact absorption, the invention increases the safety of those maneuvering around a given pole 100 while reducing damage to the pole 100 resulting from collisions. Still further, the display device 10 adapts readily to the demands of a wide variety of venues. Taken together, the advances revealed by the present invention markedly increase available advertising space while improving the safety of the general public.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim as protected by United States Letters Patent:

1. A display device for converting a pole into a simulative product display, the display device comprising:

a first body element for simulating in a magnified proportion a portion of a product to be advertised wherein the first body element has an outer surface simulating in three dimensions a portion of a product to be advertised and wherein the first body element has a pole engaging surface with a means for engaging a pole; and a second body element for simulating in a magnified proportion a portion of a product to be advertised wherein the second body element has an outer surface simulating in three dimensions a portion of a product to be advertised and wherein the second body element has a pole engaging surface with a means for engaging a pole;

a means for fastening the first body element into engagement with the second body element to form the first and second body elements into a unitary structure, the fastening means comprising at least one elongate member with a first end and a second end, a means for fastening the first end of the at least one elongate member to an inner surface of the first body element, and a means for fastening the second end of the at least one elongate member to an inner surface of the second body element wherein the at least one elongate member comprises a first elongate section and a second elongate section; and a means for fastening the first elongate section to the second elongate section to form the at least one elongate member comprising a ratcheting engagement mechanism operatively associated with the first and second elongate sections;

whereby the first body element and the second body element can be fastened into engagement surrounding a pole to cause at least a portion of a pole about which they are disposed to simulate in three dimensions a product to be advertised.

2. The display device of claim 1 wherein the first and second body elements when fastened together define an open inner volume and further comprising at least one substantially rigid reinforcing member disposed within the open inner volume with an inner edge for contacting a pole about which the first and second body elements are disposed and an outer edge for contacting the first and second body elements whereby the reinforcing member tends to prevent the first and second body elements from compressing in response to an impact to the display device.

3. The display device of claim 2 further comprising a retaining groove disposed on the inner surface of the first body element and a retaining groove disposed on the inner surface of the second body element wherein the retaining grooves cooperate to retaining the reinforcing member in position.

4. The display device of claim 2 further comprising an access aperture disposed in the outer surface of the first body element of the display device for allowing a user access to the open inner volume of the display device.

5. The display device of claim 4 further comprising a plug for sealing the access aperture when the access aperture is not in use. elements whereby the reinforcing member tends to prevent the first and second body elements from compressing in response to an impact to the display device.

6. A display device for converting a pole into a simulative product display the display device comprising:

a first body element for simulating in a magnified proportion a portion of a product to be advertised wherein the first body element has an outer surface simulating in three dimensions a portion of a product to be advertised and wherein the first body element has a pole engaging surface with a means for engaging a pole;

a second body element for simulating in a magnified proportion a portion of a product to be advertised wherein the second body element has an outer surface simulating in three dimensions a portion of a product to be advertised and wherein the second body element has a pole engaging surface with a means for engaging a pole wherein the first and second body elements when fastened together define an open inner volume;

at least one substantially rigid reinforcing member comprising a generally flat panel disposed within the open inner volume with an inner edge for contacting a pole about which the first and second body elements are disposed and an outer edge for contacting the first and second body elements whereby the reinforcing member tends to prevent the first and second body elements from compressing in response to an impact to the display device;

at least one aperture in the reinforcing member;

an impact absorbing member of impact absorbing material disposed within the at least one aperture in the reinforcing member; and a means for fastening the first body element into engagement with the second body element to form the first and second body elements into a unitary structure;

whereby the first body element and the second body element can be fastened into engagement surrounding a pole to cause at least a portion of a pole about which they are disposed to simulate in three dimensions a product to be advertised.

7. The display device of claim 6 wherein the impact absorbing member has an open inner volume.

8. The display device of claim 7 further comprising a disparate impact absorbing material disposed within the open inner volume of the impact absorbing member.

9. The display device of claim 8 wherein the disparate impact absorbing material comprises a material chosen from the group consisting of particulate matter and liquid.

10. The display device of claim 6 further comprising a retaining base for retaining a bottom end of the first and second body elements wherein the retaining base has a base floor and an annular retaining wall disposed at the periphery of the base floor wherein the annular retaining wall surrounds the first and second body elements thereby acting as a means for fastening the first body element into engagement with the second body element.

11. The display device of claim 10 further comprising a means for fastening the retaining base to the first and second body elements.

12. The display device of claim 11 wherein the means for fastening the retaining base to the first and second body elements comprises a plurality of retaining bolts.

13. The display device of claim 12 wherein the retaining bolts fixedly project from a surrounding environmental surface and wherein the retaining bolts project through the base floor of the retaining base and into the first and second body elements whereby the retaining bolts further comprise a means for fixing the display device relative to a surrounding environmental surface.

14. The display device of claim 11 wherein the means for fastening the retaining base to the first and second body elements comprises ground spikes that project through the first and second body elements, through the base floor of the retaining base, and into a surrounding environmental surface.

15. The display device of claim 6 wherein the first and second body elements when coupled together define an open inner volume and further comprising a volume of ballast disposed within the open inner volume of the display device for maintaining the display device in a given location and orientation.

16. The display device of claim 6 wherein each of the first and second body elements simulates in magnified proportion and in three dimensions a portion of a product to be advertised chosen from the group consisting of a bottled product, a boxed product, and a canned product.

* * * * *